United States Patent [19]

Beckmann et al.

[11] 4,029,361

[45] June 14, 1977

[54] LONGWALL MINING ROOF SUPPORT FOR DOUBLE DECK MACHINES

[75] Inventors: Klaus Beckmann; Heinrich Behr, both of Lunen, Germany

[73] Assignee: Gewerkschaft Eisenhutte Westfalia, Wethmar near Lunen, Germany

[22] Filed: Mar. 4, 1976

[21] Appl. No.: 663,647

[30] Foreign Application Priority Data

Mar. 6, 1975 Germany ..... 2509810

[52] U.S. Cl. ..... 299/31; 61/45 D; 299/33; 299/43

[51] Int. Cl.[2] ..... E21D 15/44

[58] Field of Search ..... 299/31–34, 299/43; 61/45 D

[56] References Cited

UNITED STATES PATENTS

| | | | |
|---|---|---|---|
| 3,280,570 | 10/1966 | Pollard | 299/43 X |
| 3,375,668 | 4/1968 | Allen | 61/45 D |
| 3,830,070 | 8/1974 | Rosenberg et al. | 61/45 D |

FOREIGN PATENTS OR APPLICATIONS

| | | | |
|---|---|---|---|
| 1,232,899 | 1/1967 | Germany | 299/34 |

*Primary Examiner*—Ernest R. Purser
*Attorney, Agent, or Firm*—Sughrue, Rothwell, Mion, Zinn & Macpeak

[57] ABSTRACT

A mineral mining installation intended for mining thick seams is composed of a series of units arranged alongside the mineral face and interconnected via a shifting system employing hydraulic rams operable to shift individual units. Each unit is a two story construction with a rigid underframe with roof and floor parts interconnected by pillars or walls to provide a winning chamber accessible to the face and an access chamber remote from the face and capable of housing vehicles and other equipment. On top of each underframe, to complete the unit, is a top frame composed of telescopic props resting on the roof part of the underframe and supporting a roof girder. At least one winning machine and conveyor is arranged within the forward regions of the frames of the units, and usually in the winning chambers; and the machine serves to hew mineral from the face.

14 Claims, 4 Drawing Figures

LONGWALL MINING ROOF SUPPORT FOR DOUBLE DECK MACHINES

BACKGROUND OF THE INVENTION

The present invention relates to mineral mining installations and more particularly to installations designed for thick-seam mineral or coal faces generally above 5 meters in thickness or height.

It is generally known to utilize a variety of roof support frames in an underground mine working. Such frames can be the so-called walking frames which can be advanced up to the mineral face and can employ goaf shields to screen off the goaf or stowage zone. A conveyor is often linked to the frames and supports of a winning machine such as a plough. These known installations are generally quite satisfactory with thin seams but are not particularly useful or efficient where the height or thickness of the mineral face is above about 3–4 meters unless special cutting techniques such as "slice working" are employed to win the mineral. There is thus a need for a simpler form of installation capable of winning thick seams without involving special cutting techniques. A general object of this invention is thus to provide an improved form of installation suitable for use with thick-seam mineral faces.

SUMMARY OF THE INVENTION

According to the invention a mineral mining installation comprises support units each having a rigid underframe resting on the floor of the working and defining therein a winning chamber adjacent the mineral face and an access chamber remote from the mineral face and an upper frame carried by the underframe and including hydraulic props for bearing on the roof of the working.

The upper frame of each unit may take the form of a shield support with a single or multi-part girder carried by the props and a goaf shield pivoted to this girder and to the underframe. The unit underframes may each be composed of rigid assemblies spaced apart and interconnected through transverse bracing members. The underframes of each unit may have an intermediate structure such as a wall or separate pillars interconnecting the roof and the floor parts of each frame at their central regions and separating the winning and access chambers. A rear wall structure forming a goaf shield preferably interconnects the floor and roof parts of each unit underframe and delimits the rear side of the access chamber. The roof part of each unit underframe can extend right up to the face to effectively close off the winning chamber at the top or else the roof part can terminate some distance from the face. The installation preferably also employs at least one conveyor and a mineral winning machine. Where the roof parts extend right up to the face, conveyors can be arranged on these roof parts and on the floor parts and independent winning machines can operate with these conveyors to separately win the upper and lower regions of the face. Instead of two winning machines a single machine working the entire face can be used however. In this case the roof parts of the unit underframes would be shortened to enable the machine to work and the machine can move on one or more guides back and forth along the face, possibly at least partly within the winning chambers. Only one conveyor need be employed in this case and this single conveyor can be supported on the floor parts. The single machine may have hewing cylinders on rotatable or pivotable arms.

Preferably there is also provided a means for shifting the individual units towards the face. The shifting means may comprise an abutment such as a beam, which extends parallel to the face and is connected through one or more double-acting hydraulic rams with each unit. The shifting system operates by extending or retracting the rams of units adjacent the one to be advanced and by locking these rams and then retracting or extending the ram or rams of the unit to be shifted which reacts against the abutment. The abutment can take the form of one or more beams extending over at least three units and possibly over all the units and arranged in or on the underframes. In one further construction the abutment is in the form of a hollow housing disposed in the access chambers of the units. This housing can have part of the rams, e.g., the cylinders, within it and can take up the entire height of the access chamber. The housing would be relatively spacious inside and may therefore accommodate ancilliary equipment such as transport vehicles, hydraulic control apparatus hose or cables and the like.

The present invention also provides a mineral mining installation comprising a plurality of support units arranged alongside a mineral face, each unit having an underframe and an upper frame disposed above the underframe, the underframe being composed of a floor part engaging on the floor of the working, a roof part supported on the floor part by at least a rear structure located remote from the face and facing the goaf zone to form a goaf shield with a chamber extending between the rear structure and the face and between the roof and floor parts and the upper frame being composed of hydraulic props carried on the roof part of the underframe, a roof-engaging girder supported by the props and a goaf shield pivotably connected between the roof girder and the underframe.

In another aspect the invention provides a mine installation which comprises several support units disposed along a mineral face and interconnected through a shifting system employing hydraulic rams operative to selectively move one of the units in relation to the other units, each unit having an underframe with a floor engaging part and an upper part which supports hydraulic props carrying a roof girder, the upper part of said underframe being spaced from the floor engaging part to provide a closed in space extending from the mineral face across the whole width of the unit to the goaf zone remote from the face, a rear part of the space relative to the face serving to accommodate equipment and a front part of the space relative to the face serving to receive at least part of a mineral winning and conveying apparatus comprising at least one conveyor and at least one winning machine which employs one or more hewing cylinders.

The present invention may be understood more readily, and various other features of the invention may become apparent, from consideration of the following description.

BRIEF DESCRIPTION OF THE DRAWINGS

Embodiments of the invention will now be described, by way of examples only, with reference to the accompanying drawings, wherein.

DESCRIPTION OF PREFERRED EMBODIMENTS

Figure 1:
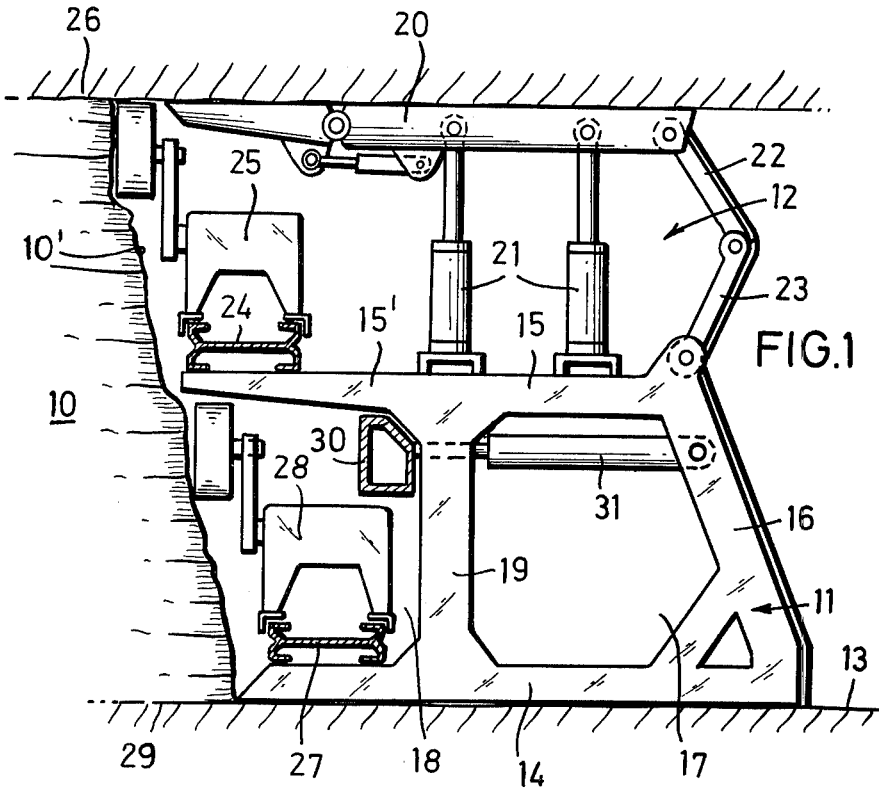
FIG. 1 is a schematic part sectional end view of one embodiment of the invention.

As shown in FIG. 1, a mineral mining installation is employed in a mine working with a mineral face 10. This face 10 contains, for example, a relatively thick coal seam, in the region of 5 to 8 meters, and the coal is to be won with the aid of the installation. The face 10 may be a short heading face or a longwall face. The installation employs a plurality of support units and winning and conveying apparatus working in conjunction with these units. Each support unit comprises a rigid underframe 11 and an upper frame 12 with hydraulic props 21 carried by the underframe 11. The height of the upper frame 12 can be varied by the operation of the hydraulic props 21. The underframe 11 is a rigid box like structure with a floor part 14 resting on the floor 13 of the working and an upper or roof part 15 disposed above the floor part 14. An inclined rear structure which may be a continuous wall or composed of inclined pillars 16 interconnects the floor and roof parts 14, 15 at the rear goaf side remote from the face 10. A cover providing a goaf shield may extend across the pillars when these are employed as the rear structure connecting the parts 14, 15. The distance between the parts 14, 15 defines a space opening to the face and extending up to the rear structure at the goaf side.

An intermediate structure which may take the form of a series of pillars 19 or a wall interconnects the floor and roof parts 14, 15 at about their central regions. This intermediate structure, e.g. the pillars 19 subdivides the space between the parts 14, 15 into an access chamber 17 enclosed by the structure of the frame 11 and a winning chamber 18 which is open to the face 10. The roof part 15 of the frame 11 forms an artificial floor for the upper frame 12 which is constructed as a shield-type support frame. More particularly, the frame 12 comprises a one-piece or in this case a multi-part roof girder 20 which extends over the roof and terminates close to the upper region 10′ of the face 10. The girder 20 as illustrated employs a pivotable front portion which can be raised or lowered by means of a hydraulic piston and cylinder unit. The girder 20 is supported by the props 21 which rest on the roof part 15 of the frame 11. A goaf shield composed of pivotably interconnected components 22, 23 is articulated to the roof part 15 of the frame 11 and to the girder 20. This shield 22, 23 screens off the goaf zone from the working zone defined within the frame 12.

The roof part 15 of the underframe 11 has a forwardly directed portion 15′ which extends right over the winning chamber 18. A scraper-chain conveyor 24 is supported on the portions 15′ of the roof parts 15 of the underframes 11 of the support units and a winning machine 25 of the hewing type is supported and guided for movement on the conveyor 24. This machine 25 wins the upper region 10′ of the face 10 between the roof and the portion 15, and the detached material is transported away by the conveyor 24. In a similar fashion a second scraper-chain conveyor 27 is arranged in the winning chambers 18 of the underframes 11 of the support units and another winning machine 28 of the hewing type is supported and guided for movement on the conveyor 27. The machine 28 wins the lower region of the face 10 between the floor and roof parts 14, 15 of the underframes 11.

In order to enable the support system composed of the support units to be moved up towards the face 10 as the winning progresses, a shifting means or apparatus is provided. This apparatus comprises an abutment in the form of a beam 30 extending generally parallel to the face and over at least three and possibly all of the support units. The beam 30 is disposed at the upper inner regions of the working chambers 18 of the units and is connected to piston rods of double-acting hydraulic rams 31. Each ram 31 locates between the pillars 19 of one of the support units and has its cylinder in the upper region of the access chamber 17 and articulated to the rear wall structure 16 of the frame 11. In order to advance one of the support units towards the face 10 the rams 31 of the neighbouring units are extended and locked hydraulically in this extended position. The props 21 of the unit to be advanced are retracted and the ram 31 of that unit to be advanced is then charged in the reverse direction to retract so that this unit is drawn up towards the face with the beams 30 and the other units acting as an abutment for the shifting force. In this way each unit can be moved up in succession.

The access chambers 17 of the units can accommodate all kinds of ancilliary equipment, such as cable and conduits, hydraulic control circuits, transport apparatus, control stations and the like.

The embodiments represented in FIGS. 2 to 4 have certain similar constructional features to the installation shown in FIG. 1 and like reference numerals as used to denote like features and for convenience only the differences will be described hereinafter.

Figure 2:
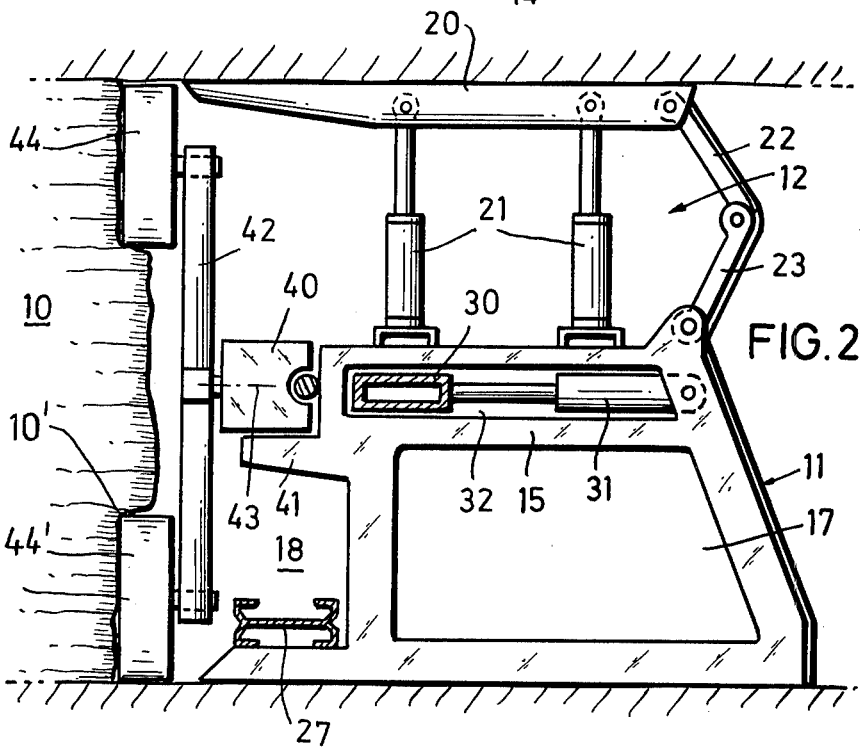
FIG. 2 is a schematic part sectional end view of a second embodiment of the invention.

Referring now to FIG. 2, the beam 30 extends through guideways 32 in the roof parts 15 of the support unit underframes 11 and the rams 31 are effectively house in these guideways 32. Instead of using two winning machines 25, 28 the embodiment of FIG. 2 employs a single winning machine 40 for working the entire face 10. This machine 40 has a body carried on a guide extending through recessed forward portions 41 of the roof parts 15 of the support unit underframes 11. The body of the machine is movable along the guide and supports two arms 42 which can pivot independently or together about an axis 43 extending generally parallel to these roof parts 15. Hewing drums or cylinders 44, 44′ are mounted at the ends of the arms 42, and by pivoting or rotating the arms 42 the cylinders 44, 44′ can engage over the complete height of the face 10. The body can then be moved along the guide to win the entire face.

Figure 3:
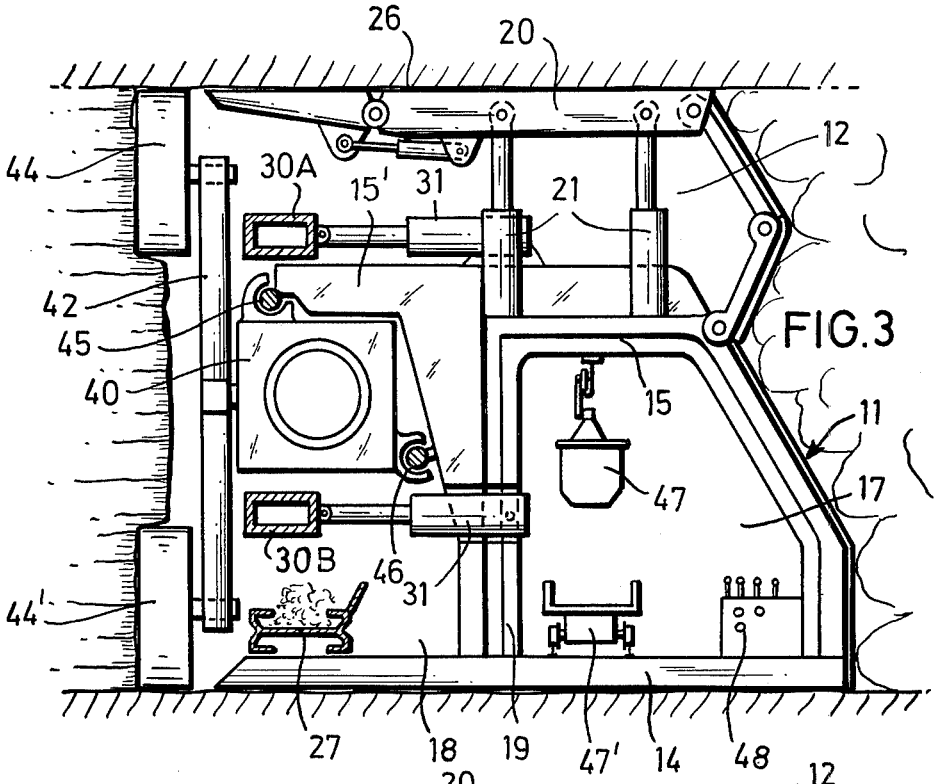
FIG. 3 is a schematic part sectional end view of a third embodiment of the invention.

As shown in FIG. 3, a third embodiment of the invention also uitlizes a single winning machine 40 which is here suspended from a guide 45 carried by the forward roof portions 15′ of the roof parts 15 of the support unit underframes 11. A further lateral guide 46 for the machine extends through the winning chambers 18 and is mounted to the pillars 19. Instead of utilizing a single support beam 30 as a shifting abutment as in FIGS. 1 and 2, the embodiment of FIG. 3 has two such beams denoted 30A and 30B. On beam 30A is arranged above the roof portions 15′ i.e. at the floor of the upper frames 12 and the other beam 30B is arranged in the winning chambers 18 of the underframes 11 and beneath the machine 40.

The beams 30A and 30B are connected via a set of rams 31 to the frames 11, 12 of each unit and these rams 31 operate simultaneously in the manner described in connection with FIG. 1 to effect shifting of the individual units. The access chambers 17 of the units accommodate a suspended trackway vehicle 47 and/or a rail track vehicle 47 for transporting equipment and one or more control stations 48 for controlling the machine 40, the rams 31 and the props 21 can be provided in one or some of the chambers 17. The underframe 11 of each unit in the embodiment of FIG. 3 consists of two assemblies spaced apart longitudinally of the face 10 and connected together via transverse bracing members or struts to form a rigid component.

Figure 4:
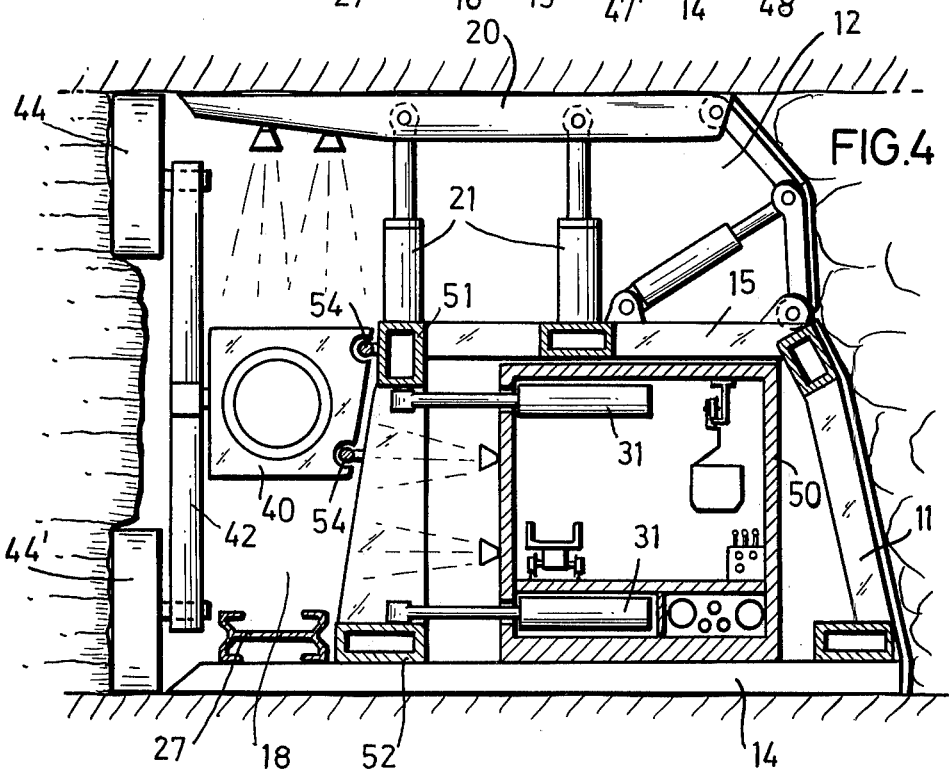
FIG. 4 is a schematic part sectional end view of a fourth embodiment of the invention.

In one embodiment represented in FIG. 4 the roof parts 15 of the underframes 11 of the support units do not have the forward projections 15', 41 as in the other embodiments so that the winning chambers 18 extend upwardly into the forward regions of the upper frames 12. The single winning machine 40 is here supported for movement along lateral guides 54 secured to the forward regions of the underframes 11. The shifting system of FIG. 4 is also modified. As shown a spacious housing 50 of reactangular configuration is disposed within the access chambers 17 of the underframes 11 of the units. The height of the housing 50 is substantially the same as that of the chambers 17. This housing 50 constitutes the abutment of the shifting system (c.f. 30 FIGS. 1 and 2). Two shifting rams 31 one above the other are provided for each unit. The cylinders of these rams 31 are accommodated in the housing 50 and connected therewith while the piston rods of the rams 31 extend through openings in the front wall of the housing and are connected to transverse girders 51, 52 forming part of the underframe 11 of the associated unit. The rams 31 are used as described before to selectively shift the individual units except that here the rams 31 of certain of the units are retracted and locked and then the rams 31 of the unit to be shifted are extended. The transverse girder 51, 52 may form part of a group of such girders as illustrated which interconnect two stable assemblies forming the underframe 11 of each unit. Preferably the rear goaf side of the assemblies of the underframes 11 are closed off with cover plates rearwardly defining the access chambers. It is also preferable to connect the assemblies of each underframe 11 with floor covers such as gratings or the like. As also shown in FIG. 1 a hydraulic piston and cylinder unit is linked to the goaf shields of the upper frames 12 of the units.

The housing 50 can extend over about three support units and with longer faces the housing 50 can be built up from sections interconnected in a resilient manner. As with the embodiment of FIG. 3, the housing 50 accommodates elevated and tracked vehicles and a control station as well as the various service conduits.

Other embodiments of the invention can be reduced by combining features of the above-described embodiments. For example, the housing 50 of FIG. 4 can be employed in the other embodiments and the double winning machine of FIG. 1 can be employed in the other embodiments if preferred.

We claim:

1. A mineral mining installation for use with a thick-seam mineral face; said installation comprising a plurality of support units each having a rigid underframe with a floor part resting on the floor of the working, a roof part and rear and intermediate structures interconnecting the roof and floor parts to define an access chamber between the roof and floor parts remote from the mineral face and a winning chamber adjacent the mineral face, the roof part extending at least over the entire area of the access chamber, and each support unit having an upper frame constituted by hydraulic props supported on the roof part of the underframe and carrying a roof girder engageable with the roof of the mine working, wherein means are provided for supporting and guiding a winning device in both the winning chamber and the face side region of the upper frame.

2. An installation according to claim 1, wherein the rear wall structure of the underframe of each unit forms a shield facing the goaf zone.

3. An installation according to claim 1, wherein the goaf shield is pivotably connected between the roof girder and the underframe.

4. An installation according to claim 1 and further comprising means for shifting the individual units towards the face.

5. An installation according to claim 4, wherein the shifting means comprises an abutment interconnected through at least one double-acting hydraulic ram with each of the units.

6. An installation according to claim 5, wherein the abutment is in the form of one or more beams extending parallel to the face.

7. An installation according to claim 5, wherein the abutment is in the form of a hollow housing located in the access chambers of the underframe and accommodating part of the shifting rams therein.

8. An installation according to claim 7, wherein the housing has a height substantially the same as that of the access chambers and ancilliary equipment is accommodated in the housing.

9. A mineral mining installation comprising a plurality of support units arranged alongside a mineral face, each unit having an underframe and an upper frame disposed above the underframe, the underframe being composed of a floor part engaging on the floor of the working, a roof part supported on the floor part by at least a rear structure located remote from the face and facing the goaf zone to form a goaf shield with a chamber extending between the rear structure and the face and between the roof and floor parts and the upper frame being composed of hydraulic props carried on the roof part of the underframe, a roof-engaging girder supported by the props and a goaf shield pivotably connected between the roof girder and the underframe, wherein an intermediate structure interconnects central regions of the floor and roof parts of each underframe to subdivide said underframe into a winning chamber adjacent the face and an access chamber, and wherein means are provided for supporting and guiding a winning device in both the winning chamber and the face side region of the upper frame.

10. An installation according to claim 9, wherein the roof parts of the underframes project up to the face and wherein conveyors are supported by the roof parts and the floor parts of the underframes of the units, each conveyor being operably associated with a respective winning machine for winning material from the face.

11. An installation according to claim 9, wherein the floor parts of the underframes support a conveyor and a mineral winning machine is guided for movement along the face.

12. A mine installation for use with a thick-seam mineral face; said installation comprising several support units disposed along a mineral face and interconnected through a shifting system employing double-acting hydraulic rams operative to selectively move one of the units in relation to the other units, the shifting system also comprising a beam extending parallel to the mineral face, the hydraulic rams being interconnected by the beam, each unit having a rigid underframe with a floor part, a roof part and rear and intermediate structures interconnecting the roof and floor parts to define an access chamber between the roof and floor parts remote from the mineral face and a winning chamber adjacent the mineral face, the roof part extending at least over the entire area of the access chamber, and each support unit having an upper frame constituted by hydraulic props supported on the roof part of the underframe and carrying a roof girder, the hydraulic props having lengths considerably less than the thickness of the seam, wherein means are provided for supporting and guiding a winning device in both the winning chamber and the face side region of the upper frame.

13. An installation according to claim 12, wherein the beam is situated in the access chambers.

14. An installation according to claim 13, wherein the beam is in the form of a hollow housing located in the access chambers of the underframes and accommodating part of the shifting rams therein.

* * * * *